US007261432B1

(12) United States Patent
Habitz

(10) Patent No.: US 7,261,432 B1
(45) Date of Patent: Aug. 28, 2007

(54) ILLUMINATED BALL AND MATING ELEMENT FOR FORMING SUCH BALL

(76) Inventor: Gerett Habitz, 2449 S. Lafayette St., Denver, CO (US) 80210

( * ) Notice: Subject to any disclaimer, the term of this patent is extended or adjusted under 35 U.S.C. 154(b) by 169 days.

(21) Appl. No.: 11/021,943

(22) Filed: Dec. 24, 2004

(51) Int. Cl.
*A63B 43/06* (2006.01)
*A63H 33/22* (2006.01)

(52) U.S. Cl. ..... 362/196; 362/182; 446/219; 441/13; 473/570

(58) Field of Classification Search ..... 362/109, 362/196, 182; 446/219; 441/13; 473/570
See application file for complete search history.

(56) References Cited

U.S. PATENT DOCUMENTS

| | | | | |
|---|---|---|---|---|
| 2,020,484 | A * | 11/1935 | Turner | 473/570 |
| 3,229,976 | A | 1/1966 | Allen, Jr. | |
| 3,804,411 | A * | 4/1974 | Hendry | 473/570 |
| 4,479,649 | A | 10/1984 | Newcomb et al. | |
| 4,930,776 | A | 6/1990 | Newcomb et al. | |
| 4,963,117 | A | 10/1990 | Gualdoni | |
| 5,080,359 | A | 1/1992 | Thill | |
| 5,102,131 | A | 4/1992 | Remington et al. | |
| 5,236,383 | A | 8/1993 | Connelly | |
| 5,403,000 | A | 4/1995 | Woosley | |
| 5,609,411 | A | 3/1997 | Wang | |
| 5,683,316 | A | 11/1997 | Campbell | |
| D388,559 | S | 12/1997 | Mauldin, Jr. | |
| 5,916,048 | A | 6/1999 | Hurell et al. | |
| 6,059,676 | A | 5/2000 | Seymour et al. | |
| 6,155,700 | A * | 12/2000 | Hsu | 362/363 |
| 6,428,432 | B1 * | 8/2002 | Kachel | 473/570 |
| 6,575,855 | B1 * | 6/2003 | Buzak et al. | 473/570 |
| 6,726,580 | B2 | 4/2004 | Peterson | |
| 6,733,149 | B1 * | 5/2004 | Chuang | 362/86 |
| 2001/0049311 | A1 * | 12/2001 | Lewis et al. | 473/570 |
| 2002/0137582 | A1 * | 9/2002 | Yu | 473/570 |
| 2003/0199343 | A1 | 10/2003 | Ilcsisin et al. | |

* cited by examiner

*Primary Examiner*—Jong-Suk (James) Lee
*Assistant Examiner*—Ismael Negron
(74) *Attorney, Agent, or Firm*—Marian J. Furst

(57) ABSTRACT

An illuminated ball formed by two substantially identical mating elements. Each mating element has an exterior surface bounded by an edge, an annular surface joined to said exterior surface at the edge, two opposed radial recesses formed in the annular surface, a well abutting a portion of the annular surface and one of the recesses, and an alignment guide abutting a portion of the annular surface and the other of the recesses. The alignment guide extends away from the exterior surface and includes a hole therethrough in alignment with the recesses. The mating element is matable with a second, substantially identical mating element by the well of each mating element receiving the alignment guide of the other element. The channel formed by the cooperation of the recesses and holes of both mating elements is sized to contain a light source.

13 Claims, 3 Drawing Sheets

ILLUMINATED BALL AND MATING ELEMENT FOR FORMING SUCH BALL

FIELD OF THE INVENTION

The present invention relates generally to an illuminated toy and more specifically to an illuminated ball for use by humans and pets.

BACKGROUND OF THE INVENTION

Balls have been used for recreational activities for centuries. All sorts of ball games are played by humans, with formal or informal rules and balls that are spherical or toroidal in shape. Examples of ball games include catch, baseball, softball, football, basketball, soccer, volleyball, rugby, croquet, tennis, table tennis, etc. Balls have also been used for recreational activities with and by pets. One such game is fetch, played with dogs. Also, balls can be rolled or tossed to other animals, with the animal stopping or catching the ball. These games use balls of all sizes, sometimes as small as marbles and sometimes as large as beach balls. In general, recreational activities using balls are limited to daylight unless the playing area is artificially illuminated or the ball is illuminated.

Many illuminated balls have been proposed, with sources of illumination placed on the surface of the ball or within the interior of the ball. In the latter case, the ball is formed from a material that is at least partly transparent or translucent so that light can be transmitted from the interior through the wall. The source of illumination may be a phosphorescent material, a chemiluminescent material, or an electrical light source.

However, several problems are encountered with the manufacturing and/or use of many of the previously developed illuminated balls. If the light source can move around within the interior of the ball, it changes the weight distribution and performance of the ball while in use, and it may also damage the light source. Thus, some mechanism is generally used to hold the light source in place within the ball. Often, the ball is formed with a single spherical or toroidal exterior shell that has a tube extending into the interior of the shell for holding the light source. Most designs include end caps, springs, clamping mechanisms, and/or other retaining means to hold or apply pressure to light source and retain the source within the tube.

One example of a ball with two hemispherical shells is croquet or bocce ball described in U.S. Pat. No. 3,804,411 to Hendry. The two hemispheres mate with each other via tongue and groove features at the edges of hemispheres, and two interior tubes attached to the shells also mate with each other, such as with screw threads.

If the light source is electrical and the ball is used for activities where it is subjected to impacts, such as being thrown into the air and landing on the ground, being caught between a dog's jaws, being kicked, or being hit with a bat, mallet, or other hard object, there is a high risk that some part of the electrical system will fail. Thus, the ball and light system must be designed to minimize impact damage. Also, the ball must be designed in a way that prevents water from reaching the electrical components and causing a short circuit.

In addition to functioning reliably during long-term use, it is desirable for many applications that the ball and the light source should be inexpensive to manufacture and maintain. Further, replacement parts should be easy to obtain and install.

Thus, there is a need for an illuminated ball that is easy and inexpensive to manufacture, durable, and uses a light source that is inexpensive and easy to replace.

SUMMARY OF THE INVENTION

To achieve the foregoing and other objects and in accordance with the purpose of the present invention broadly described herein, one embodiment of this invention comprises a kit including two mating elements for assembling a ball. Each mating element comprises a hemitoroidal exterior surface bounded by an edge, with an annular surface joined to the exterior surface at the edge. There are two opposing, aligned recesses in the annular surface, oriented radially inward from the edge. In addition, each mating element comprises a well abutting a portion of the annular surface and one of the recesses, with the well extending toward the exterior surface. Also, each mating element comprises an alignment guide abutting a portion of the annular surface and the other of the recesses, with the alignment guide extending away from the exterior surface and having a hole therethrough in alignment with the aligned recesses. The two mating elements are substantially identical in shape and size and are matable with each other to form a ball, with the edges contacting each other, the annular surfaces contacting each other, and each alignment guide extending into the well of the other mating element, thereby positioning the aligned recesses and the holes to define a channel through the mated elements. The channel is sized to contain a light source.

The kit may further comprise a light source sized to fit inside the channel defined between the mating elements and to be retained inside the channel by friction with walls of the channel. The light source may be a chemiluminescent light source. The surfaces of the mating elements may be substantially hemispherical. There may be an engagement means for holding the mating elements together, and the engagement means may be selected from tape, glue, hook and loop fasteners, ratchet-like mechanisms, tongue and groove mechanisms, and combinations thereof. In addition, the kit may comprise retaining means to hold a light source within the channel of a ball formed from the matable elements. The alignment guides may be hollow.

Another embodiment of the present invention comprises a ball formed from two substantially identically shaped and sized mating elements. Each mating element comprises a hemitoroidal exterior surface bounded by an edge, with an annular surface joined to the exterior surface at the edge. The annular surface includes two opposing, aligned recesses oriented radially inward from the edge. Each mating element also includes a well abutting a portion of the annular surface and one of the recesses, with the well extending toward the exterior surface, and an alignment guide abutting a portion of the annular surface and the other of the recesses. The alignment guide extends away from the exterior surface, with a hole passing through the guide in alignment with the aligned recesses. The two mating elements are substantially identical in shape and size. They are mated with each other, with the edges contacting each other, the annular surfaces contacting each other, and each alignment guide extending into the well of the other mating element, thereby positioning the aligned recesses and the holes to define a channel through the mated elements. The channel is sized to contain a light source.

The ball may further comprise a light source positioned within the channel. The light source may be selected from chemiluminescent light sources, phosphorescent light sources, and electrical light sources. The light source and the channel may be substantially cylindrical in shape, with the light source having an outer diameter approximately the same as the inner diameter of the channel, such that the light source is retained within the channel by friction. There may also be a means for retaining the light source inside the channel through the ball, such as caps that seal the ends of the channel. The two mating elements may be engaged together with an engagement means, such as tape, glue, hook and loop fasteners, ratchet mechanisms, tongue and groove mechanisms, or combinations thereof. The ball may be less dense than water.

Another embodiment of the present invention comprises a mating element for a ball. The element has a hemitoroidal exterior surface bounded by an edge and an annular surface joined to the exterior surface at the edge. The annular surface includes two opposing, aligned recesses oriented radially inward from the edge. The mating element also includes a well abutting a portion of the annular surface and one of the recesses and an alignment guide abutting a portion of the annular surface and the other of the recesses. The well extends toward the exterior surface, and the alignment guide extends away from the exterior surface and has a hole therethrough in alignment with the aligned recesses. The mating element is matable with a second, substantially identical mating element to form a ball having a channel passing therethrough, with the channel sized to contain a light source.

BRIEF DESCRIPTION OF THE DRAWINGS

These and other features, aspects, and advantages of the present invention will become better understood with reference to the following description, appended claims, and accompanying drawings, where:

DESCRIPTION OF THE INVENTION

One embodiment of the present invention comprises a ball 100, as shown in FIGS. 1-5. The ball 100 comprises two identical mating elements 102*a* and 102*b* that meet at a seam 104 that runs around the circumference of the ball 100. Mating elements 102*a* and 102*b* each have a substantially hemispherical exterior surface 106*a* and 106*b*, respectively, with openings 108*a* and 108*b*, 110*a*, and 110*b*, respectively, on opposing sides of seam 104. Each opening 108*a*, 108*b*, 110*a*, and 110*b* has a substantially semicircular profile at its intersection with the respective exterior surface 106*a* or 106*b*. The mating elements 102*a* and 102*b* are mated with each other such that the openings 108*a* and 108*b* are aligned with each other to form openings 112 and 114 in the exterior of the ball, centered on the seam 104 between the mating elements 102*a* and 102*b*. The openings 112 and 114 are aligned with each other along an axis passing through the ball, and they form the ends of a channel passing through the interior of the ball, as will be discussed below. Ball 100 can be of any size that is suitable for its intended use.

The mating elements 102*a* and 102*b* are formed from a material that is at least partly transparent or translucent to allow light to pass from the interior of the ball to the exterior. Preferably, the material is selected to be suitable for the intended purpose of the ball. More preferably, the material is unbreakable and will withstand punctures, such as a plastic, so that the ball can survive impacts that will inevitably occur during use for recreational activities. Such impacts may include throwing; catching; landing on the ground; bouncing; being hit with a bat, mallet or racquet; being gripped between an animal's teeth; being batted by an animal with claws, etc.

Figure 1:
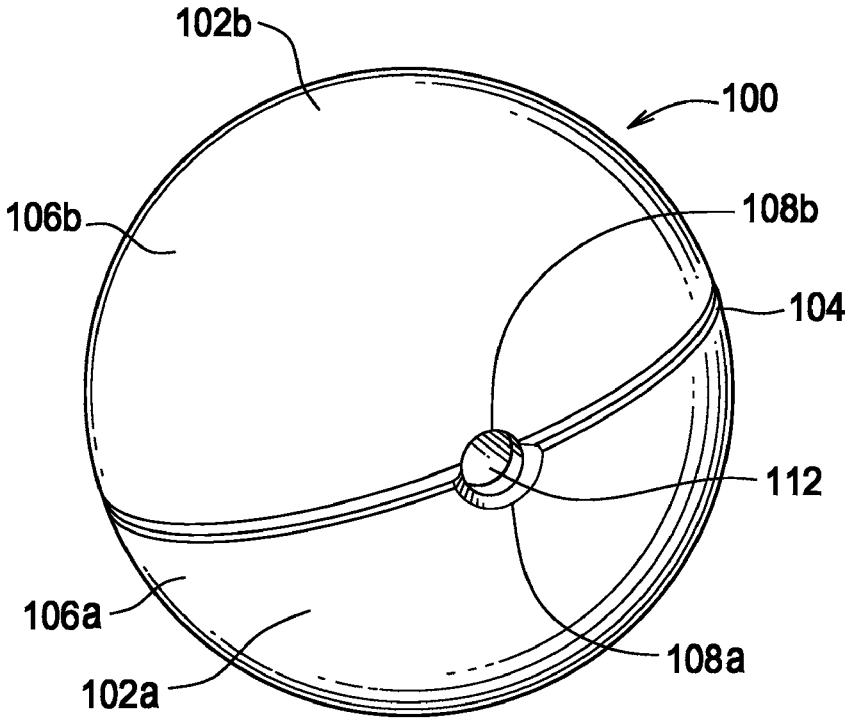
FIG. 1 is a perspective view of the exterior of a ball in accordance with the present invention.
Figure 2:
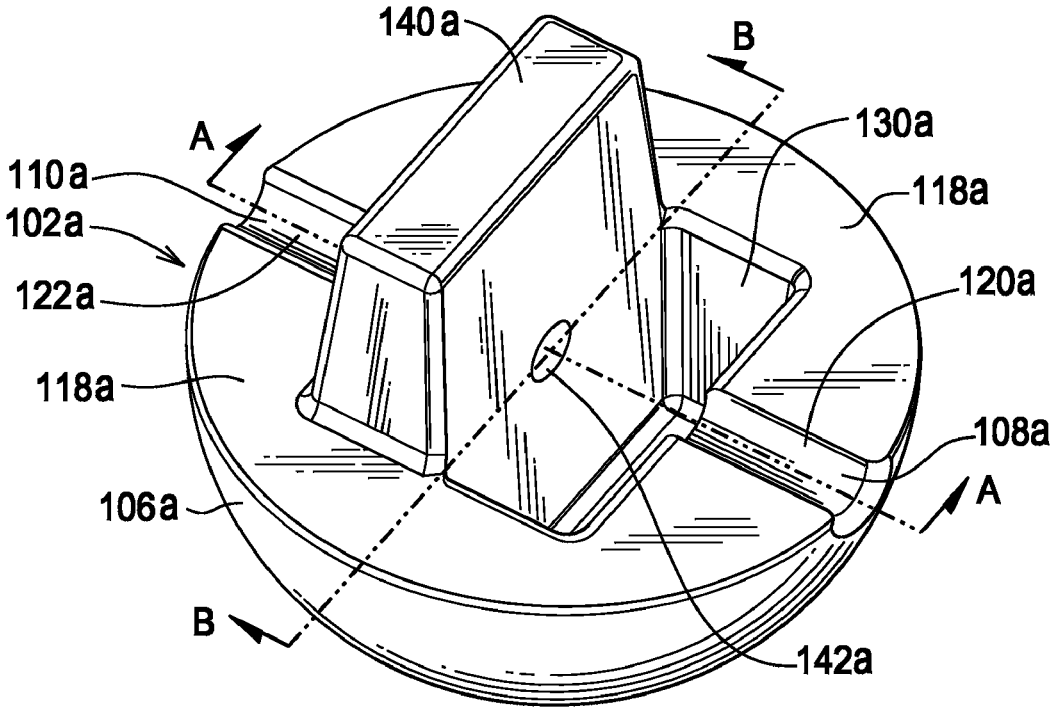
FIG. 2 is a perspective view showing the interior surfaces of a mating element of the ball of FIG. 1.

As shown in FIG. 1, the exterior surfaces 106*a* and 106*b* of mating elements 102*a* and 102*b* are uniform, but they could have a pattern or texture, and the pattern or texture may create a pattern in the light emanating from the ball. The pattern may simulate seams, such as those found on baseballs, footballs, soccer balls, basketballs, volleyballs, etc., or the pattern may be purely ornamental. As shown in FIGS. 1-5, a ball in accordance with the present invention has a substantially spherical outer surface. It should be noted that the outer surface may not be spherical, but rather, it may have any shape, such as might be used for a football or rugby ball.

Mating elements 102*a* and 102*b* have annular surfaces 118*a* and 118*b* that join exterior surfaces 106*a* and 106*b*, respectively. Surfaces 118*a* and 118*b* include aligned semi-cylindrical recesses 120*a*, 120*b*, 122*a*, and 122*b*, respectively, extending radially inward from openings 108*a* and 108*b*. As shown, annular surfaces 118*a* and 118*b* are planar. Alternatively, the surfaces of the two mating elements that contact each other and are joined to the exterior surfaces may not be planar. Indeed, they could be ridged or scalloped or have other surface features that mate with each other.

Wells 130*a* and 130*b* and alignment guides 140*a* and 140*b* are positioned between the semi-cylindrical recesses 120*a* and 120*b* and between semi-cylindrical recesses 122*a* and 122*b*, respectively, abutting annular surfaces 118*a* and 118*b*. As shown, wells 130*a* and 130*b* and alignment guides 140*a* and 140*b* have approximately rectangular cross sections, with the longer dimension perpendicular to the alignment axis of recesses 120*a*, 120*b*, 122*a*, and 122*b*. Wells 130*a* and 130*b* and alignment guides 140*a* and 140*b* also are oriented substantially perpendicular to annular surfaces 118*a* and 118*b*. Cylindrical holes 142*a* and 142*b* extend through alignment guides 140*a* and 140*b*, respectively, and are aligned with semi-cylindrical recesses 120*a*, 120*b*, 122*a*, and 122*b*.

Although wells 130*a* and 130*b* and alignment guides 140*a* and 140*b* are shown in FIGS. 2-5 having rectangular cross sections, other shapes are possible, as long as the guides fit into the wells. Further, there could be multiple wells and alignment guides (not shown). Each alignment guide may be formed integrally with the rest of the mating element, or it may be manufactured as a separate piece and then mounted to the mating element, such as by gluing, welding, or any other method known in the art. If the mating element is formed by a casting or molding process, it may be solid and too dense for the intended use. A hollow alignment guide may be molded or cast for subsequent attachment to the solid body of the mating element, thereby decreasing the density of the ball. This may be desirable, for example, if the ball should float on a body of water. It should be noted that the alignment guide and well structures may add strength and rigidity to the ball structure.

Figure 3:
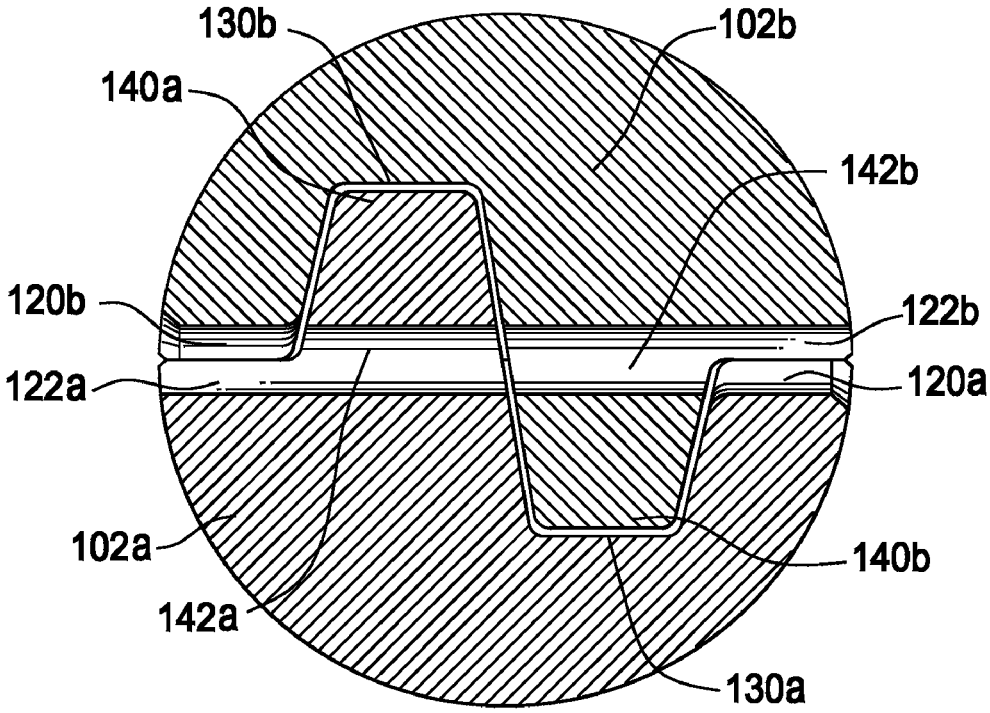
FIG. 3 is a cross section along plane A-A showing the relationship between two mating elements of the ball of FIG. 1.
Figure 4:
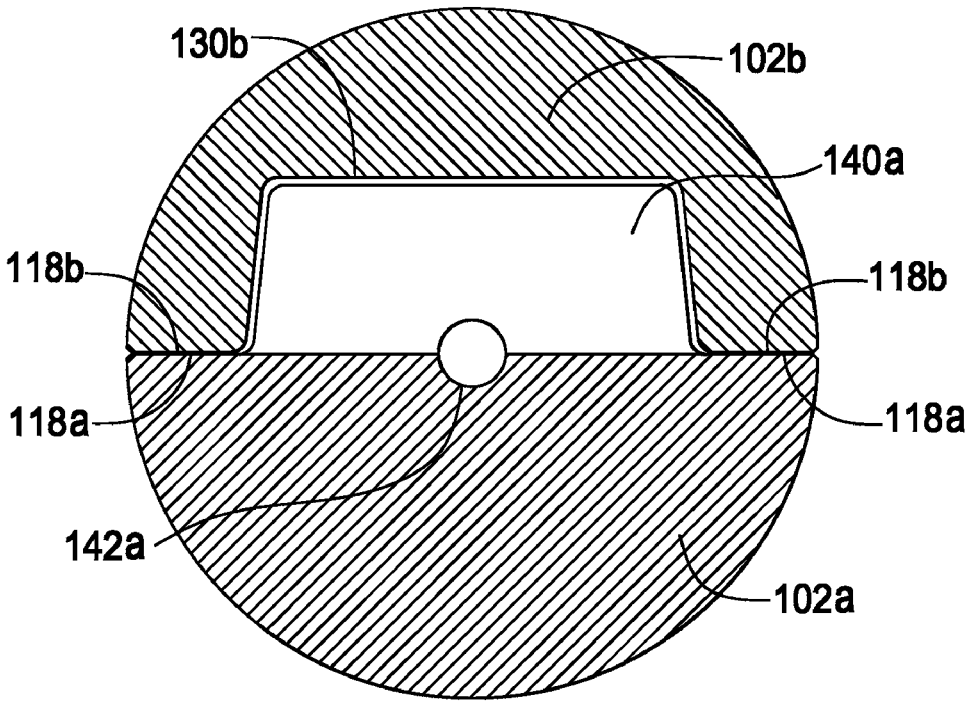
FIG. 4 is a cross section along plane B-B showing the relationship between two mating elements of the ball of FIG. 1.
Figure 5:
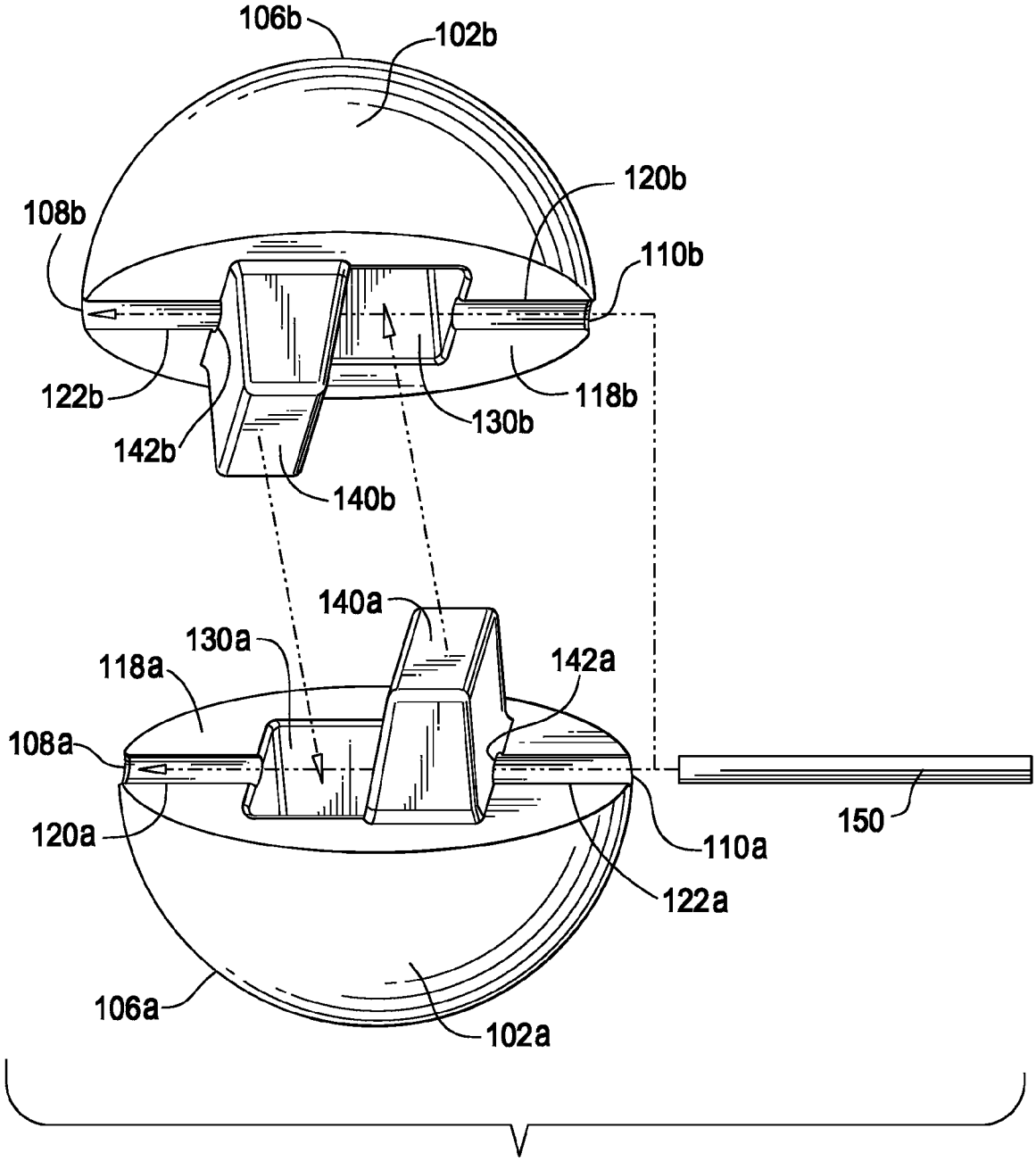
FIG. 5 is an exploded perspective view of a ball in accordance with the present invention.

As shown in FIGS. 3-5, two mating elements 102*a* and 102*b* can be mated with each other such that alignment guide 140*a* of element 102*a* is inserted into well 130*b* of element 102*b*, and alignment guide 140*b* is inserted into well 130*a*. When mated, annular surfaces 118*a* and 118*b* are in contact with each other, semi-cylindrical recesses 120*a* and 122*b* form a cylindrical opening 112; recesses 120*a* and 122*b* form a cylindrical opening 114; and openings 112 and 114 and holes 142*a* and 142*b* are aligned with each other to form a cylindrical channel extending completely through the interior of ball 100.

The two mating elements 102*a* and 102*b* may be held together by a cylindrical light source that fits tightly into the cylindrical channel through ball 100. Thus, the diameters of openings 124 and 126 and holes 142*a* and 142*b* should be selected such that a light source 150 fits within the channel and is held in place by friction. Any light source may be used that is suitable for the intended use of the ball in terms of size, cost, durability, and the amount of light and heat generated. Preferably, the light source is a chemiluminescent source. Alternatively, another type of chemiluminescent, phosphorescent, or electrical light source (not shown) could be used. If the source is electrical, the light may be produced by a bulb or an LED, and it may be powered by one or more disposable or rechargeable batteries. Preferably, the light source is sized such that it does not protrude beyond the exterior surface of the ball. A protruding light source could prevent the ball from rolling, bouncing, traveling through the air, etc. as desired, and it could also be damaged during impacts or when bitten or clawed by an animal who is playing with the ball. Optionally, one or more reflective surfaces (not shown) could be provided, such as on one or more surfaces of the interior portion of one or both mating elements.

In a preferred embodiment, the two mating elements are identical and are rotated 180 degrees with respect to each other to fit together, and only the cylindrical light source is required to hold the mating elements together to form a ball. In this case, the mating elements can be manufactured more efficiently and at lower cost than if they are not identical. As shown in FIGS. 2-5, the alignment guides 140*a* and 140*b* fit into the wells 130*b* and 130*a* of the opposing mating element. Preferably, the alignment guides and the wells are dimensioned so that they fit together well, with the well at least as large in all dimensions as the alignment guide.

Other embodiments are within the scope of this invention. For example, it may be desirable to use one or two caps to seal the ends of the channel into which the light source is inserted, either to keep the light source in place, to prevent water from contacting it, or to protect it from animal teeth that might penetrate the ball. In this last case, it may also be desirable to protect pets or other animals from chemicals that might be released if a chemiluminescent or phosphorescent light source is punctured or bitten. These caps may be secured by any means known in the art, including but not limited to tape, friction fitting, threaded engagement with the insides of the recesses in the mating elements, or a ratchet-like engagement mechanism. The light source and the recesses and holes into which it is inserted may have a cross sectional shape other than circular, such as a polygonal or oblate cross section.

To hold the two mating elements together, it may be desirable to use a means in addition to or instead of the friction fit of the light source in the recesses and hole that form the interior channel of the ball. For example, there may be an engagement means (not shown), such as tape, glue, hook and loop fasteners, a tongue and groove arrangement, or a ratchet-like mechanism. The engagement means may be located at or near the joint between the interior and exterior surfaces, or it may be located on interior surfaces of the mating elements, such as on the surfaces 118*a* and 118*b* or on the surfaces of the wells 130*a* and 130*b* and the alignment guides 140*a* and 140*b* in FIGS. 2-5.

The mating elements 102*a* and 102*b* of ball 100 can be made by any method known in the art for shaping solid objects, including but not limited to carving, molding, casting, and sculpting. The alignment guide may be made separately from the body portion of a mating element and attached subsequently by any attachment method known in the art. The preferred method for manufacturing the mating elements is injection molding, because it is relatively inexpensive and suitable for large-scale manufacturing.

Ball 100 can be assembled by positioning the two mating elements 102*a* and 102*b* against each other so that alignment guide 140*a* extends into well 130*b* and alignment guide 140*b* extends into well 130*a*, such that surfaces 118*a* and 118*b* are in contact with each other. When the two mating elements are properly assembled, semi-cylindrical recesses 120*a* and 122*b* match up with each other to form cylindrical opening 124, and semi-cylindrical recesses 120*b* and 122*a* line up with each other to form cylindrical opening 126 in ball 100. Also, the cylindrical openings 124 and 126 are aligned with holes 142*a* and 142*b* in the alignment guides, thereby forming a channel extending all the way through ball 100 with channel ends at holes 112 and 114. A light source 150, sized to fit and be retained within the channel is then inserted into the channel. It may be necessary to activate or switch the light source 150 on before inserting it into the channel. For example, a glow stick light source must be activated prior to insertion.

The ball may be used for any recreational activity appropriate for its size, hardness, resiliency, etc. It may be hit, rolled, or thrown during any game, such as catch between humans, throw and fetch with a dog, or another game with an animal such as a cat, dog, ferret, rodent, seal, etc.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. A kit comprising two mating elements for assembling a ball, each mating element comprising:

an exterior surface bounded by an edge;

an annular surface joined to said exterior surface at said edge including two opposing, aligned recesses oriented radially inward from said edge;

a well abutting a portion of said annular surface and one of the recesses, the well extending toward said exterior surface; and an alignment guide abutting a portion of said annular surface and the other of said recesses, said alignment guide extending away from said exterior surface and having a hole therethrough in alignment with said aligned recesses;

wherein said mating elements are substantially identical in shape and size and are matable with each other to form a ball, with said edges contacting each other, said annular surfaces contacting each other, and each alignment guide extending into the well of the other mating element, thereby positioning the aligned recesses and the holes to define a channel through the mated elements, wherein the channel is sized to contain a light source.

2. The kit of claim 1, further comprising a light source sized to fit inside the channel defined between said mating elements and to be retained inside the channel by friction with walls of the channel.

3. The kit of claim 2, wherein said light source is a chemiluminescent light source.

4. The kit of claim 1, wherein said surfaces are substantially hemispherical.

5. The kit of claim 1, further comprising engagement means for holding said mating elements together.

6. The kit of claim 1, further comprising retaining means to hold a light source within the channel of a ball formed from the matable elements.

7. A ball formed from two substantially identically shaped and sized mating elements, wherein each mating element comprises:

an exterior surface bounded by an edge;

an annular surface joined to said exterior surface at said edge, said annular surface including two opposing, aligned recesses oriented radially inward from said edge;

a well abutting a portion of said annular surface and one of the recesses, the well extending toward said exterior surface; and an alignment guide abutting a portion of said annular surface and the other of said recesses, said alignment guide extending away from said exterior surface and having a hole therethrough in alignment with said aligned recesses;

wherein said mating elements are substantially identical in shape and size and are mated with each other, with said edges contacting each other, said annular surfaces contacting each other, and each alignment guide extending into the well of the other mating element, thereby positioning the aligned recesses and the holes to define a channel through the mated elements, wherein the channel is sized to contain a light source.

8. The ball of claim 7, further comprising a light source positioned within the channel.

9. The ball of claim 7, wherein said light source and the channel are substantially cylindrical in shape, and said light source has an outer diameter approximately the same as the inner diameter of the channel, such that the light source is retained within the channel by friction.

10. The ball of claim 7, further comprising means for retaining said light source inside the channel through the ball.

11. The ball of claim 7, further comprising means for engaging said mating elements.

12. The ball of claim 7, wherein said ball is less dense than water.

13. A mating element for a ball, said element comprising:

an exterior surface bounded by an edge;

an annular surface joined to said exterior surface at said edge, said annular surface including two opposing, aligned recesses in said annular surface, oriented radially inward from said edge;

a well abutting a portion of said annular surface and one of the recesses, the well extending toward said exterior surface; and an alignment guide abutting a portion of said annular surface and the other of said recesses, said alignment guide extending away from said exterior surface and having a hole therethrough in alignment with said aligned recesses;

wherein said mating element is matable with a second, substantially identical mating element to form a ball having a channel passing therethrough, with the channel sized to contain a light source.

* * * * *